United States Patent [19]

Cunningham

[11] Patent Number: 4,832,206

[45] Date of Patent: May 23, 1989

[54] ARTICLE HOLDING DEVICE FOR DISHWASHERS

[76] Inventor: George D. Cunningham, 236 E. Auburn Dr., Tempe, Ariz. 85283

[21] Appl. No.: 182,382

[22] Filed: Apr. 18, 1988

[51] Int. Cl.[4] ..... A47G 19/08

[52] U.S. Cl. ..... 211/41; 211/119.1; 211/89

[58] Field of Search ..... 211/41, 183, 74, 181, 211/82, 83, 84, 89, 119.1; 134/137, 135, 156; 312/270, 271, 272; 135/96, 104

[56] References Cited

U.S. PATENT DOCUMENTS

| | | | |
|---|---|---|---|
| 955,231 | 4/1910 | Vandenburgh . | |
| 2,206,174 | 7/1940 | Falk | 211/119.1 |
| 2,233,725 | 3/1941 | Begin et al. | 211/119.1 |
| 2,237,361 | 4/1941 | Foynter | 65/65 |
| 2,508,491 | 5/1950 | Cayo | 211/119.01 |
| 2,899,079 | 8/1959 | Davis | 211/74 |
| 3,289,854 | 12/1966 | Kauffman | 211/41 |
| 3,612,285 | 10/1971 | Mason | 211/41 |
| 3,616,806 | 11/1971 | Randall | 134/168 R |
| 3,901,728 | 8/1975 | Opal | 134/25 A |
| 4,006,950 | 2/1977 | Murray | 312/270 |
| 4,434,898 | 3/1984 | McCarthy | 211/119.01 X |
| 4,635,799 | 1/1987 | Penner | 211/41 |
| 4,748,993 | 6/1988 | Llewellyn | 211/89 X |

*Primary Examiner*—J. Franklin Foss
*Assistant Examiner*—Sarah A. Lechok Eley
*Attorney, Agent, or Firm*—LaValle D. Ptak

[57] ABSTRACT

An article holding device, for holding down relatively light-weight articles onto the open wire rack of a dishwasher, is in the form of a stretchable, elongated rectangular mesh. The mesh is attached at opposite ends to rigid plastic connector bars which may be placed on the outside of the dishwasher rack across adjacent vertical support wires. The elasticity or resiliency of the mesh when the connector bars engage the support wires on opposite ends of the dishwasher rack causes the mesh member to stretch across, and exert a downward force onto, articles placed beneath it on the rack to prevent such articles from bouncing out of position during operation of the dishwasher.

21 Claims, 1 Drawing Sheet

ARTICLE HOLDING DEVICE FOR DISHWASHERS

BACKGROUND

Automatic dishwashing machines are widely used in commercial applications and now also are commonplace in most homes. Typically, dishes in such machines are deposited in open wire work baskets or dishware racks located above upwardly and laterally directed jets of cleaning fluid. In most home dishwashers, the jets of cleaning fluid are upwardly projected from a rotatable spray; arm and the fluid exerts considerable upward force on the various articles placed on the dishware rack. Bowls, glasses, cups, saucers, pitchers and the like are placed on the racks with the inside or hollow side facing downwardly for direct impingement by the high-pressure fluid projected from the cleaning jets.

A combination of the strength of the chemicals in the cleaning fluid and the pressure of the fluid jets results in the cleaning of the various dishes. Jets of higher pressure are preferred for items which are difficult to clean, that is, items which have food particles adhereing to them. High pressure jets, however, tend to lift and turn over dishes, particularly lightweight dishes, causing the dishes to be turned over and leave the hollow side facing upwardly away from the impact of the high pressure fluid jets. When this occurs, the inside of such dishes are not cleaned and they tend to become filled with wash water splashing off the walls and the top of the cleaning compartments of the dishwasher. If the pressure of the fluid jets is lessened to prevent the turning over of lightweight dishes, the cleaning action of the dishwasher is correspondingly reduced. To overcome the reduction in cleaning action which occurs, stronger cleaning solutions may be employed, but strong cleaning solutions tend to harm some dishes or the finish on the dishes.

Another result of the use of high pressure jets of cleaning solution or fluid is that, even if the dishes are not turned over. They tend to shift about in the dishware rack or basket and bounce against one another. For fragile dishes, the result of such movement can result in breaking or chipping of the dishes. This obviously is undesirable.

In an effort to overcome the tendency for some dishes, particularly lightweight dishes, to be overturned by high pressure jets of fluid, devices have been developed for commercial dishwashers to hold the dishes in place on the rack during the washing cycle. Two patents which are directed to systems for accomplishing this result are the U.S. Pat. to Randall No. 3,616,806 and Murray No. 4,006,950. Both of these patents are directed to commercial dishwashes where a relatively heavy, limp, metal mesh is lowered on top of the articles placed in the rack in the dishwasher. The weight of the metal mesh on top of the articles prevents them from moving from the position in which they are placed during the washing action of the dishwasher. In the Murray Patent, the mesh is automatically raised and lowered in response to the movement of the work basket as the basket is withdrawn and inserted into the machine. In the device of the Randall Patent, the mesh is in the form of several transverse bands which are wound up on support shafts at the sides of the machine interior. After the articles to be washed are placed on the washing rack, the support shafts are rotated to unwind the mesh bands and lower them onto the tops of the articles on the washing rack. The devices disclosed in both of the these patents are quite complex, requiring additional mechanical parts to be mounted in the interior of the dishwasher cleaning chamber. The heavy metal hold-down mesh also is cumbersome and remains within the machine at all times.

Four other patents which are directed to attempts to prevent the movement of dishes as a result of the force of the cleaning fluid in a dishwasher, are the U.S. Patents to Kauffman No. 3,289,854; Davis No. 2,899,079; Opal No. 3,901,728; and Mason No. 3,612,285. All four of these patents are directed rigid hold-down devices for retaining articles in place on the rack of a dishwasher. In Kauffman, the device is a clip which presses a glass or cup against an upright post. In Davis, a rigid hold-down perforated cover is employed. In the Opal Patent, a movable disk is rotated down over cups and articles to be held in place; and the device disclosed in the Mason Patent is an arrangement of pivoted retainer rods. All of these devices are connected in some way or another to the dishwasher interior or to the rack, and all of them are rigid devices or clamps for placing pressure on the top or sides of the article to be held in place. This prevents movement of the articles to be cleans when they are subjected to the pressure of the high pressure jets of cleaning fluid.

It is desirable to provide a simple and effective hold-down device for a dishwasher which is capable of securely holding lightweight articles in place on the dishwasher rack during the washing operation. It further is desirable for such a hold-down device to be inexpensive, simple to construct and to use, without requiring any modification of a standard dishwasher.

SUMMARY OF THE INVENTION

Accordingly, it is an object of this invention to provide an improved article holding device for dishwashers.

It is another object of this invention to provide an improved article holding device for use in conjunction with the dishware rack of dishwashers.

It is an additional object of this invention to provide an improved article holding device for maintaining the position of dishes on the rack of a dishwasher during the washing operation.

It is a further object of this invention to provide an improved dishware holding device which is adaptable to holding dishes of a variety of shapes and configurations in place on the dishware rack of a dishwasher during the washing operation.

In accordance with a preferred embodiment of this invention, a holding device is used in conjunction with dishwashers which have an open dishware rack made of wire-like support elements forming the bottom, ends, and sides of the rack. The holding device includes a flexible resilient mesh member in the general shape of an elongated rectangle for overlying at least a portion of the bottom of the rack. The mesh member extends substantially across the space between the ends of the rack, and elongated rigid connector bars are attached to the opposite ends of the mesh member. These bars have a length sufficient to extend across the width of the mesh member, and this length also is greater than the distance between adjacent support elements on the ends of the dishware rack. Consequently, when the connector bars are placed across support elements on opposite ends of the dishware rack on the outside of the rack, the mesh member is stretched over the top of dishes which are placed beneath it on the rack to hold these dishes in place during the washing operation.

DETAILED DESCRIPTION

Figure 1:
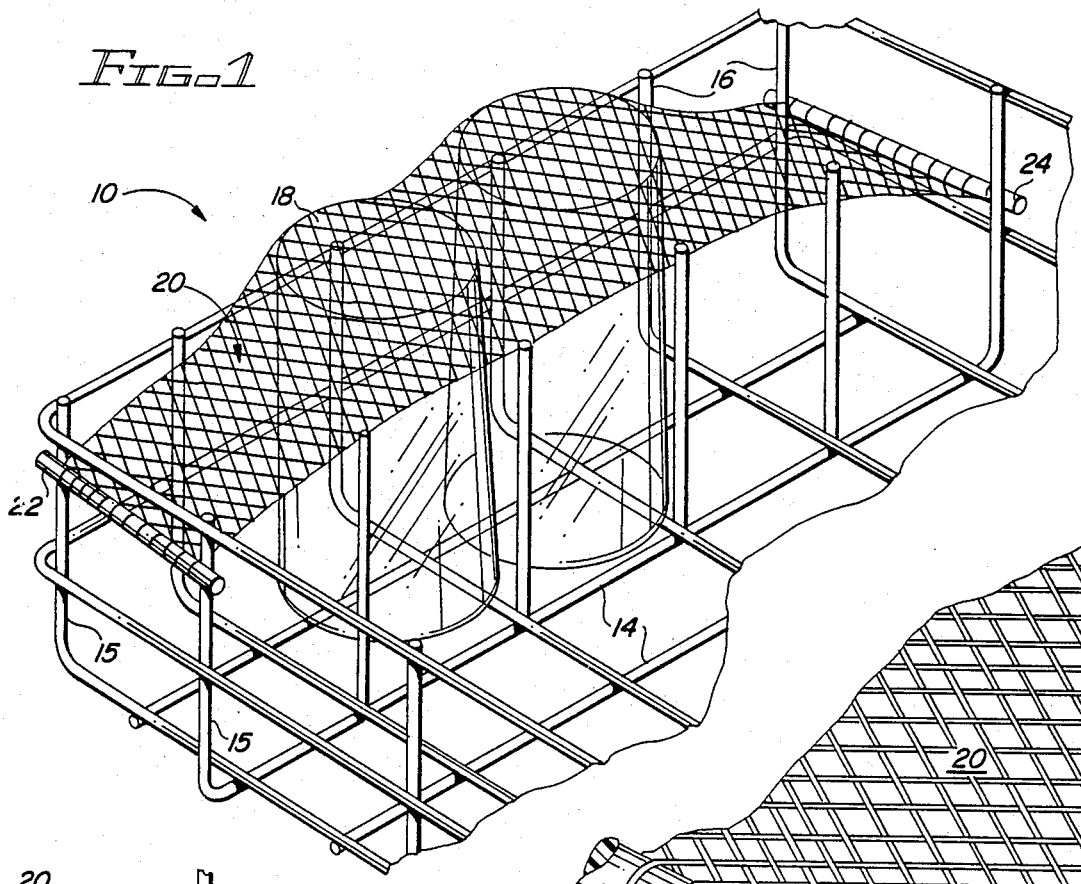
FIG. 1 is a perspective view of a preferred embodiment of the invention showing its manner of use.

Reference now should be made to the drawing in which the same reference numbers are used throughout the different figures to designate the same components. FIG. 1 is a partially cut-away perspective view of a typical dishwasher rack 10 of the type used in most home and commercial dishwashers. The rack 10 is made in the form of an open basket with relatively widely spaced apart bottom wire support elements 14 which are connected along the ends and sides, and at intermediate points within the rack, to vertical end support members 15 and side support members 16. The support members 14 extend from end to end and side to side in a criss-cross pattern to form the bottom of the rack and typically are simply turned upwardly on the ends to form the vertical end support members 15 and side support members 16 of the rack 10.

When relatively lightweight articles, such as glasses, cups, and storage containers made of plastic, are placed in an inverted position on the rack 14, it is desirable to hold them in place against the upward force of the jets of cleaning fluid. Some typical dishware articles 18 are illustrated in dotted lines in FIG. 1. To hold these articles in place, a fabric mesh or net 20, is stretched over the top of the articles as illustrated in FIG. 1 by attaching the mesh 20 at opposite ends to a pair of elongated connector bars or rods 22 and 24. As shown in FIG. 1, these connector bars are placed on the outside of the dishware basket and have a length sufficient to extend across a space greater than the distance between adjacent ones of the upright supports 15. When the bars 22 and 24 are placed as shown in FIG. 1 to stretch the mesh or net 20 across the top of the dishes 18, the mesh holds the dishes down against the support members 14 in the bottom of the rack to prevent displacement of the dishes during the cleaning operation.

To obtain the desired resilient and stretching characteristics of the mesh 20, it preferably is cut in the shape of an elongated rectangle with a length sufficient to stretch it between the bars 22 and 24 when they are placed in the position shown in FIG. 1. Typically the width of the mesh member 20 is slightly greater than the distance between adjacent ones of the upright supports 15 of a standard dishware rack or, alternatively, is approximately the width of the various rows in a top rack where glasses, cups and the like normally are placed for washing.

Figure 2:
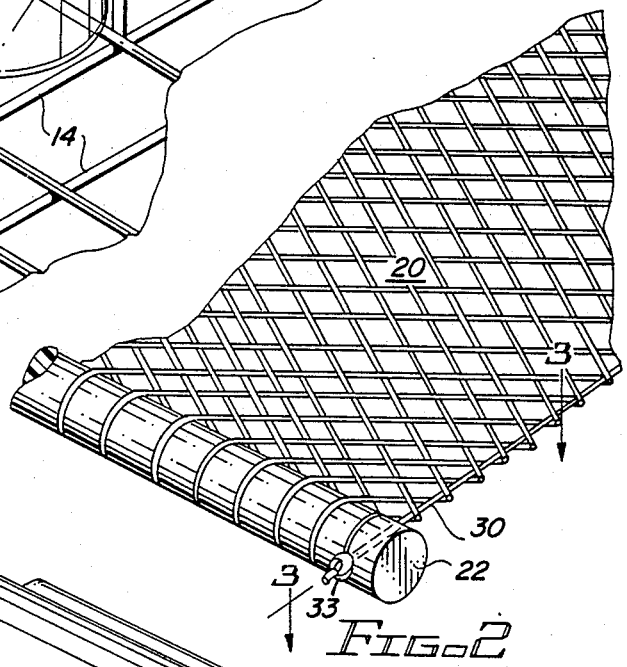
FIGS. 2 and 3 show details of the construction of the embodiment shown in FIG. 1.

The mesh 20 is made of two sets of parallel strands 26 and 28 which intersect one another at right angles and which are interconnected at the intersection points. These strands in turn may be made of machine crocheted thread or other elastic material, so that some degree of elasticity occurs in the direction of the lengths of the intersecting threads 26 and 28. As is well known, when a mesh, such as the mesh 20, is pulled in the direction of the diagonals, a substantial elongation can take place. Consequently, the mesh 20 is attached to the connector bars or rods 22 and 24 on the diagonal or at 45° to these bars, as shown most clearly in FIGS. 2 and 3. The manner of attachment may be in any suitable manner; and as illustrated in FIG. 2, the bar 22 simply is inserted through the end loops of the mesh 20 by threading it through these loops. A similar connection is made at the other end with the connector bar 24.

Figure 3:
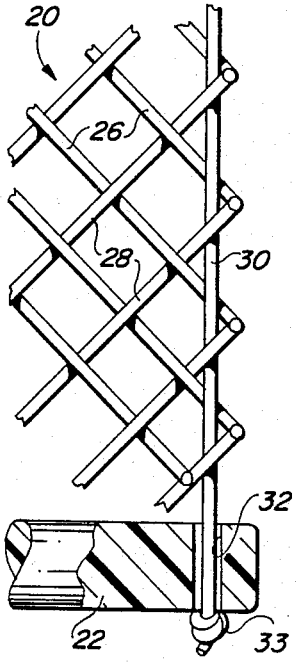

Lateral support for the edges of the mesh is provided by means of a pair of cord or string segments 30 located on each side and threaded through the edges of the mesh 20, as shown most clearly in FIG. 3. As illustrated in FIGS. 2 and 3, the cord segments 30 are attached to the bars 22 and 24 by passing them through holes 32 drilled through the bars and securing them in place by means of a knot 33 on the opposite side. Only one such connection has been shown, but all four connections (both ends of both cords 30) are made in the same manner.

The bars 22 and 24 may be made of any suitable rigid material such as wood or plastic. Typically, the bars 22 and 24 are made of plastic and the mesh members 26 and 28 are made of nylon, so that the moisture, chemicals and heat which are present within the dishwasher do not have any deleterious effects over a prolonged period of use. The cords 30 may be made of nylon or they may be elastic cords to improve the stretching and hold down characteristics of the mesh 20 when it is placed over dishes 18 on the rack 10.

Figure 4:
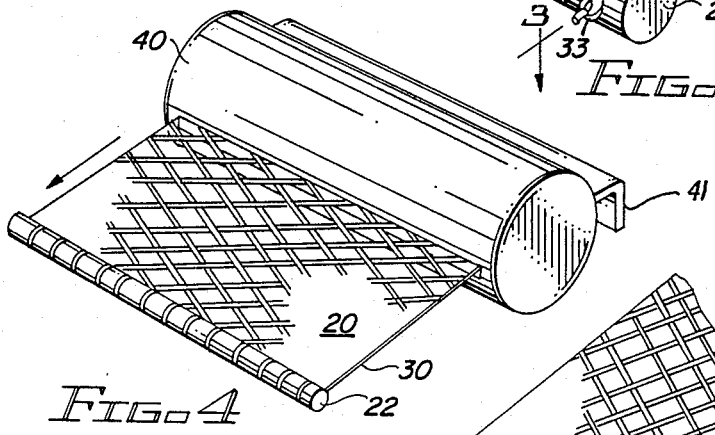
FIG. 4 illustrates another preferred embodiment of the invention.

FIG. 4 illustrates another version of an embodiment which replaces the connector bar or rod 24 with a retractable roller 40. The roller 40 then may be mounted on the rear end of the dishwasher rack 10 by means of a downwardly turned flange 41 connected to the rack in any suitable manner. When the hold down feature provided by the mesh 20 is not desired, the mesh is rolled up within the roller 20, and the connector bar 22 is in place across an opening in the housing for the retractable roller 40. The mechanism of the roller 40 has not been shown, since it may be any suitable type of roller mechanism, such as the type commonly employed with window shades and the like. When use of the mesh 20 to hold down dishes is desired, the bar 22 is pulled outwardly in the direction of the arrow to extend the mesh 20 across the dishes 18, as shown in FIG. 1, with the bar 22 then secured in place across the outside of a pair of upright support rods 15 or 16 of the dishware rack 10.

Figure 5:
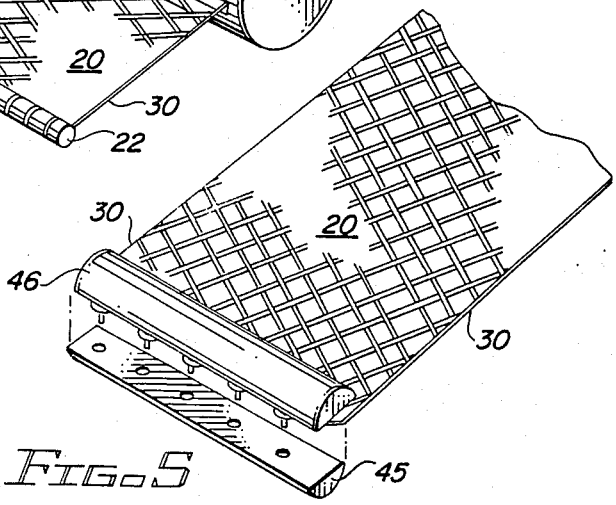
FIG. 5 shows an alternative construction of a portion of the embodiment shown in FIGS. 1, 2 and 3.

FIG. 5 illustrates another embodiment which may be used in place of the bars 22 and 24. In the embodiment shown in FIG. 5 a split bar consisting of a pair of rigid elongated half cylindrical member 45 and 46 are employed. The member 45 has a number of holes in it, and the member 46 has a corresponding number of aligned plastic projections which may be inserted between appropriate ones of the openings or apertures in the ends of the mesh 20. The entire assembly then is pressed together in a sandwich-like configuration to hold the cords 30 and the mesh 20 in place between the two halfs 45 and 46. A simple pressure fit or a suitable adhesive or thermal bonding may be employed to secure the parts 45 and 46 together. The end result is a structure which is similar to the one shown in FIGS. 1, 2 and 3 and which operates in the same manner as described above in conjunction with the embodiment of FIGS. 1, 2 and 3. Other techniques also may be used for securing the mesh 20 to a suitable connector bar or rod, if desired.

Figure 6:
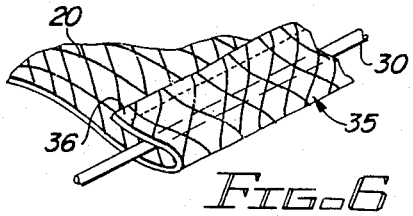
FIG. 6 shows an alternative construction which may be used in the embodiments shown in FIGS. 1 through 5.

FIG. 6 illustrates an alternative technique for securing the elongated cord segments 30 on the opposite edges of the mesh member 20. As illustrated in FIG. 6, instead of threading the cords through the various apertures along the edges of the mesh 20, the edges simply are folded over the cord (at 35) and then the folded-over edges are sewn back onto the main body of the mesh 20 by means of suitable stitches 36. The technique illustrated in FIG. 6 simplifies the construction of the hold-down device. This embodiment otherwise operates in exactly the same manner as described above in conjunction with the embodiment of FIGS. 1, 2 and 3.

The mesh or net of an actual working embodiment has substantially square aperatures in it of approximately ⅛ inch between the threads 26 or 28. The relative dimensions of the apertures and threads 26 and 28 shown in FIG. 3 are approximately those which exist in such a working embodiment.

The foregoing description of the preferred embodiments of the invention should be considered as illustrative of the invention and not as limiting. Various changes and modifications will occur to those skilled in the art, such as variations in the dimensions and materials which have been mentioned. Different techniques may be used to removably secure the mesh over articles on the rack, such as by employing hold down bars and interconnectors in a variety of different configurations. Such variations will occur to those skilled in the art without departing from the true scope of the invention as defined in the following claims.

I claim:

1. An article holding device for dishwashers having an open dishware rack made of wire-like support elements forming the bottom, ends, and sides of such rack, said device including in combination:

a flexible resilient mesh member with a predetermined amount of elasticity in the shape of an elongated rectangle, having first and second edges and first and second ends, said mesh member dimensioned to overlie at least a portion of the bottom of said rack and extending substantially across the space between the ends thereof;

first and second elongated, connector means attached to the first and second ends, respectively, of said mesh member for removable connection to support elements on opposite ends of said dishware rack to stretch said mesh member over the top of articles placed beneath it on said dishware rack to hold such articles in place said mesh member substantially conforming to the shape of the tops of such articles.

2. The combination according to claim 1 wherein said connector means comprise first and second elongated, substantially rigid connector bars, each extending across the width of said mesh member and having a length greater than the distance between adjacent support elements on the ends of said dishware rack, such that said connector bars are placed across adjacent ones of such support elements on opposite ends of said rack to stretch said mesh member across such articles, and said mesh member is made of non-metallic material.

3. The combination according to claim 2 wherein said mesh member is a fabric mesh member made of fabric cords, the mesh openings of which are of substantially greater width than the width of the fabric cords of which the mesh member is made.

4. The combination according to claim 2 wherein said mesh member is made of nylon thread.

5. The combination according to claim 4 wherein said mesh member is made of multi-strand fabric threads in first and second parallel sets of threads, the threads of each set being perpendicular to the threads of the other set, with the threads of both sets extending at an angle of substantially 45° to said first and second edges and said first and second ends of said mesh member.

6. The combination according to claim 5 further including first and second elongated cord segments attached substantially throughout the length thereof to the first and second edges, respectively, of said mesh member, with the opposite ends of each of said cord members being attached, respectively, to said first and second connector bars.

7. The combination according to claim 6 wherein each of said first and second connector bars have first and second holes therethrough adjacent opposite ends thereof, and said cord segments are attached to said connector bars by passing the ends of said cord segments through said holes and securing said cord segments on the opposite side of said connector bars from the side on which said mesh member is located.

8. The combination according to claim 6 wherein said first and second cord segments are attached, respectively, to said first and second edges of said mesh member by weaving said cord segments through said mesh member adjacent the first and second edges thereof.

9. The combination according to claim 8 wherein said cord segments are made of elastic material.

10. The combination according to claim 6 wherein said cord segments are attached to said first and second edges of said mesh member by folding said first and second edges of said mesh member over said first and second cord segments, respectively, and securing said folded over portions of said mesh member to the remainder thereof to enclose said cord segments.

11. The combination according to claim 10 wherein said cord segments are made of elastic material.

12. The combination according to claim 6 wherein said connector bars are rigid plastic bars.

13. The combination according to claim 1 wherein said mesh member is a fabric mesh member made of fabric cords, the mesh openings of which are of substantially greater width than the width of the fabric cords of which the mesh member is made.

14. The combination according to claim 13 wherein said mesh member is made of nylon thread.

15. The combination according to claim 14 wherein said mesh member is made of multi-strand fabric threads in first and second parallel sets of threads, the threads of each set being perpendicular to the threads of the other set, with the threads of both sets extending at an angle of substantially 45° to said first and second edges and said first and second ends of said mesh member.

16. The combination according to claim 1 further including first and second elongated cord segments attached substantially throughout the length thereof to the first and second edges, respectively, of said mesh member, with the opposite ends of each of said cord members being attached, respectively, to said first and second connector bars.

17. An article holding device for dishwashers having an open dishware rack made of wire-like support elements forming the bottom, ends, and sides of such rack, said device including in combination:

a retractable roller means for mounting on an end of said dishware rack;

a flexible resilient mesh member with a predetermined amount of elasticity in the shape of an elongated rectangle, having first and second edges and first and second ends, for overlying at least a portion of the bottom of said rack and for extending substantially across the space between the ends thereof, said mesh member attached at said first end thereof to said rectractable roller means; and a rigid connector bar attached to said second end a rigid connector bar attached to said second end of said mesh member and extending across the width of said mesh member, said connector bar having a length greater than the distance between adjacent support elements on the ends of said dishwasher rack, such that when said connector bar is placed across adjacent support elements of said dishware rack on the opposite end thereof from said retractable roller means, said mesh member stretches over and substantially conform to the top of articles placed beneath it on said dishware rack to hold such articles in place.

18. The combination according to claim 17 wherein said mesh member is a fabric mesh member made of fabric cords, the mesh openings of which are of substantially greater width than the width of the fabric cords of which the mesh member is made.

19. The combination according to claim 18 further including first and second elongated cord segments attached substantially throughout the length thereof to the first and second edges, respectively, of said mesh member, with the opposite ends of each of said cord members being attached, respectively, to said first and second connector bars.

20. The combination according to claim 19 wherein said mesh member is made of nylon thread.

21. The combination according to claim 20 wherein said connector bar is a rigid plastic bar.

* * * * *